US011458510B2

(12) United States Patent
Perez et al.

(10) Patent No.: US 11,458,510 B2
(45) Date of Patent: Oct. 4, 2022

(54) BLADE CLEANING AND STORAGE SYSTEM

(71) Applicants: Dariel Perez, San Antonio, TX (US); Dariel Perez, Jr., San Antonio, TX (US)

(72) Inventors: Dariel Perez, San Antonio, TX (US); Dariel Perez, Jr., San Antonio, TX (US)

( * ) Notice: Subject to any disclaimer, the term of this patent is extended or adjusted under 35 U.S.C. 154(b) by 147 days.

(21) Appl. No.: 16/809,454

(22) Filed: Mar. 4, 2020

(65) Prior Publication Data

US 2021/0276049 A1 Sep. 9, 2021

(51) Int. Cl.

| | |
|---|---|
| ***B08B 1/00*** | (2006.01) |
| ***A47L 25/00*** | (2006.01) |
| ***B26B 21/40*** | (2006.01) |

(52) U.S. Cl.

CPC ..... *B08B 1/002* (2013.01); *A47L 25/00* (2013.01); *B26B 21/4037* (2013.01); *B26B 21/4075* (2013.01); *A46B 2200/30* (2013.01)

(58) Field of Classification Search

CPC ..... B08B 1/002; A47L 15/0015; A47L 15/37; A47L 15/0089; A47L 15/0068; A47L 17/00; A47L 25/00; B44C 7/02; A63B 57/60; A46B 11/00

See application file for complete search history.

(56) References Cited

U.S. PATENT DOCUMENTS

| | | | | |
|---|---|---|---|---|
| 5,404,610 | A * | 4/1995 | Coyer, Sr. | A63B 57/60 15/104.92 |
| 5,626,272 | A * | 5/1997 | Klemansky | B44C 7/02 224/674 |
| 5,652,993 | A * | 8/1997 | Kreyer | A46B 11/00 15/160 |
| 5,997,655 | A * | 12/1999 | Schang | B08B 1/00 134/6 |
| 7,200,891 | B1 * | 4/2007 | McCulloch | A46B 7/00 15/104.92 |
| 8,607,397 | B1 * | 12/2013 | Caver | A46B 9/026 15/160 |
| 8,992,693 | B2 * | 3/2015 | Currell | B08B 3/006 134/31 |
| 9,560,952 | B2 * | 2/2017 | Clark | A47L 15/0015 |
| 2002/0152568 | A1 * | 10/2002 | Dillinger | E04F 21/16 15/104.92 |

* cited by examiner

*Primary Examiner* — Shay Karls
(74) *Attorney, Agent, or Firm* — Nick Guinn; Gunn, Lee & Cave, P.C.

(57) ABSTRACT

A device for cleaning and organizing sheetrock knives is disclosed. The device includes a panel having an orifice covered on at least one side with brush bristles. The panel has at least one slot for holding sheetrock knives and may contain additional compartments for holding utility knives and pencils. When a user places the device in a five gallon bucket, she may rinse and brush sheet rock knives using the orifice and cleaning liquid in the bucket or she may store the knives and other tools in the slots and other compartments.

16 Claims, 10 Drawing Sheets

BLADE CLEANING AND STORAGE SYSTEM

CROSS REFERENCES TO RELATED APPLICATION

Not applicable.

FEDERALLY SPONSORED RESEARCH OR DEVELOPMENT

Not applicable.

BACKGROUND OF THE INVENTION

1. Field of the Invention

The present invention relates to the cleaning and storage of sheetrock knives. More specifically, the invention is a device comprising a panel that rests inside of a container (e.g., a five gallon bucket) wherein the panel has an orifice with brushes on one side of the orifice, and one or more slots for holding sheetrock knives.

2. Description of the Related Art

The equipment necessary to install sheetrock generally consists of: a pencil, one or more sheetrock knives; a drywall hammer; a drywall rasp; and a drywall utility saw. The process of taping and floating sheetrock generally consists of: a mud mixer; a scraper(s); joint knives; taping knives; a mud tray; and one or more buckets. Buckets are frequently used to hold water, but alternatively carrying one or more of the tools. Users might also require a tape measure; chalk; chalk line; sheetrock nails and a roll of tape. These tools have remained relatively unchanged for decades. Likewise, the process for installing sheetrock and taping and floating have remained relatively unchanged for decades. The individual tools have improved to the extent a tool is now constructed from lighter materials; stronger; faster; cordless; or more accurate. Some tools are sold in individual storage cases (e.g., a pencil case; a knife pouch). These changes increase productivity and improve organization. However, there have been little to no improvements for cleaning these tools nor organizing the collection of tools.

Information relevant to attempts to address these problems can be found in U.S. Pat. Nos. 8,992,693; 5,997,655; 5,652,993; 5,404,610; 5,626,272; 9,560,952; 7,200,891; and 8,607,397; and U.S. Patent Application No. 2002/0152568. However, each one of these references suffers from one or more disadvantages, including: lack of storage; inefficient use; bulkiness; just to name a few. For the foregoing reasons, there is a need for a system that is self-contained; minimizes space; improves organization; reduces weight; cleans and dries tools; etc.

Moreover, the present invention eliminates several aspects of the traditional cleaning process, which requires the use of both hands dunking tools into a five gallon bucket of water, and scrubbing the tools. Washing and keeping drywall tools wet is necessary for drywall operators to reach professional results. Cleaning drywall knives is repeated frequently (e.g., often twenty or more times during a working day). The invention eliminates the need for the operator's hand(s) coming into contact with water—thus, improving efficiency and reducing likelihood of blisters—requires only one hand for cleaning (rather than two) and improves the speed of cleaning.

BRIEF SUMMARY OF THE INVENTION

It is an object of the present invention to provide for improved organization of knives and other sheetrock tools.

It is a further object of the invention to provide for improved cleaning of sheetrock tools.

It is a further object of the invention to provide for improved drying of sheetrock tools, when necessary, such as the end of the project.

It is a further object of the invention to provide a device for keeping knives wet—if desired—while work is in progress.

It is a further object of the invention to provide a system that accommodates different size buckets and containers.

It is a further object of the invention to provide a device that aids mixing of mud.

It is a further object of the invention to minimize the number of pieces and simplify assembly.

These and other objects of the present invention will become apparent to those of skill in the art upon review of this specification, including its drawings and claims.

DETAILED DESCRIPTION OF THE INVENTION

Figure 1:
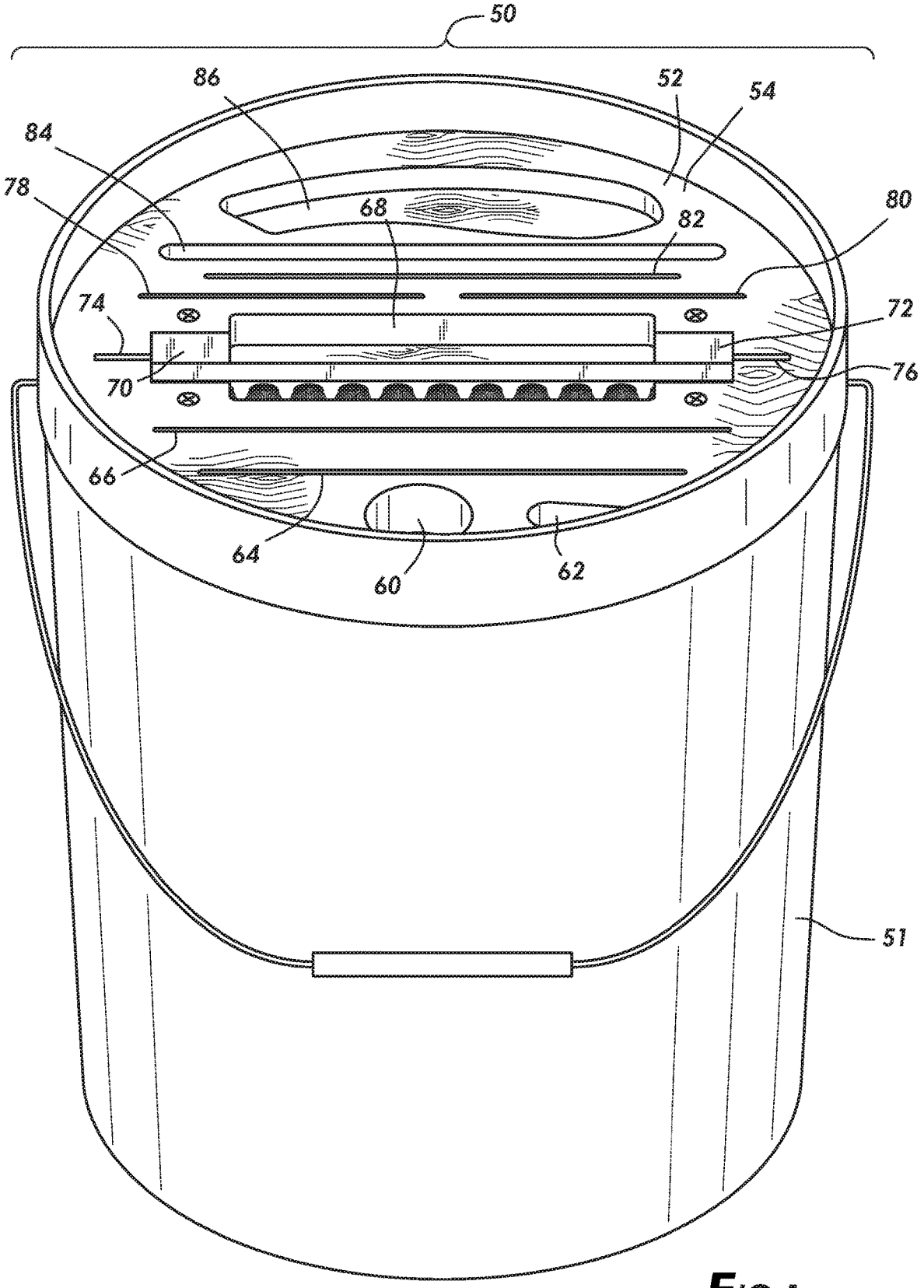
FIG. 1 is a perspective view of one embodiment of the present invention.

FIG. 1 illustrates an embodiment of the present invention: a device 50 comprising a container 51 and a panel 52. This figure shows the panel 52 positioned inside of the container 51. In this embodiment, the panel 52 is removable from the container. It is held in place by gravity, as well as friction between the panel 52 and the interior of the container 51. In this embodiment the panel is generally a circular/cylindrical shape having a top face 54, a bottom face 56 (shown in FIG. 3) and a side face 58 (shown in FIG. 4). The panel 52 is generally a circular/cylindrical shape here because container 51 is a similar shape and having the similar shapes allows for the panel 52 to rest at a desired height inside of the container 51.

In this embodiment, the top face 54 of the panel 52 has several orifices, slots, cutouts and holders. Specifically, hammer holes 60, 62, a first slot 64, a second slot 66, an orifice 68, a first cutout 70, a second cutout 72, a third slot 74, 76, a fourth slot 78, a fifth slot 80, a sixth slot 82, a pencil holder 84, and a utility knife holder 86.

Some of the slots are collinear (i.e., next to each other) (e.g., the fourth slot 78 and the fifth slot 80). Smaller knives and saws do not require as large of a slot. That attribute allows collinear slots in certain instances. By contrast, some slots are too big to allow a collinear slot (e.g., the second slot 66). And the third slot 74 is especially long. It extends through and beyond the orifice 68, the first cutout 70 and the second cutout 72. By positioning the third slot 74 such that it intersects the orifice 68 and the cutouts 70, 72, it allows for an efficient use of space (i.e., options). At this particular position, the third slot 74 is collinear with a diameter of the top face 54. By making the third slot 74 collinear with a diameter of the top face 54, the designer/user can maximize the width of a slot (e.g., the third slot 74). The orifice 68 is approximately the shape of a rasp 125 (shown in FIG. 6) only slightly larger. Important to this embodiment, the orifice 68 is sufficiently long and wide to accomodate the lengths and widths of commercially available rasps.

The dimensions of five gallon buckets vary between models. That said, it is not uncommon for five gallon bucket to range from approximately fourteen inches to twenty-two inches in height. Interestingly, it is common for five gallon buckets—regardless of specific dimensions to have a diameter that is larger at the top (i.e., opening) of the bucket than at the bottom (i.e., base) of the bucket. One reason for this feature is that stacking multiple buckets becomes easier. This attribute also lends itself to the operation of the present invention. That is, if the outer diameter of the panel 52 is less than the inner diameter at the top of the container 51 and greater than the diameter at the bottom of the bucket, the panel 52 will rest inside the container 51 somewhere between its top and bottom. As for specific dimensions, many buckets have an outer diameter that is between eleven and twelve inches at the top of the bucket and an outer diameter that is between ten and eleven inches at the bottom of the bucket.

Figure 2:
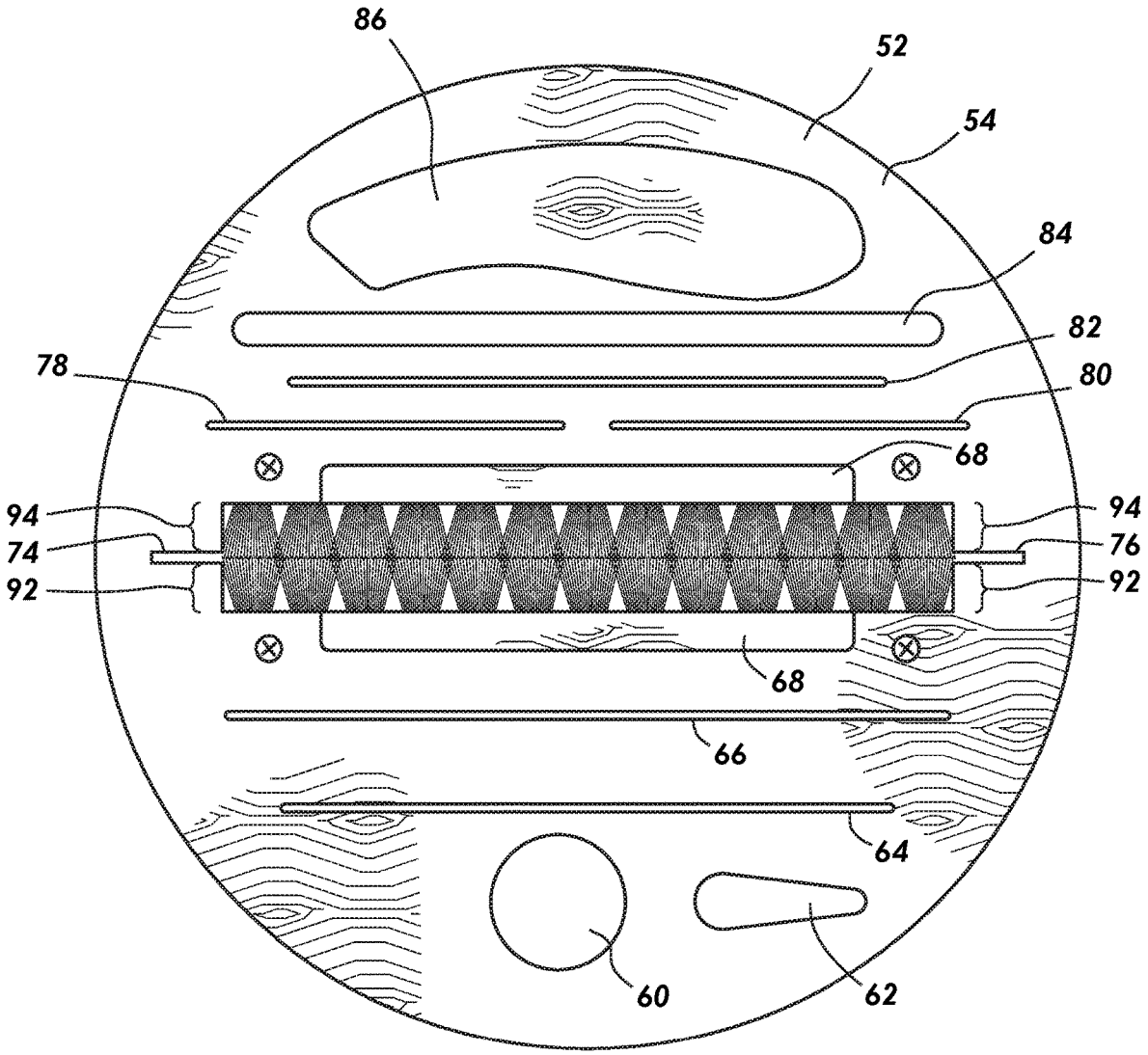
FIG. 2 is a top plan view of part of the embodiment shown in FIG. 1.

FIG. 2 illustrates the top face 54 of the panel 52 when the panel 52 is not positioned inside of the container 51.

Figure 3:
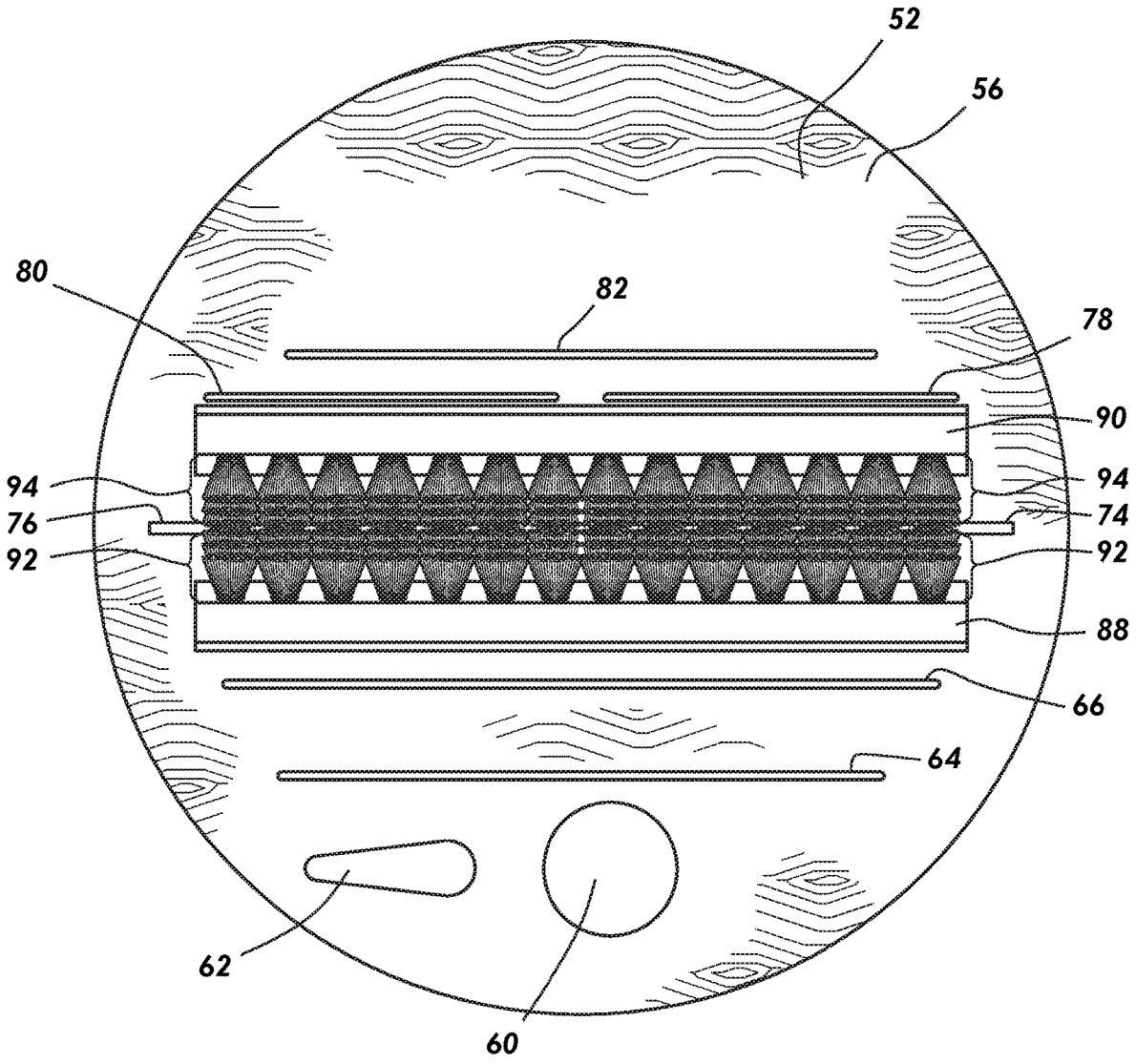
FIG. 3 is a bottom plan view of part of the embodiment shown in FIG. 1.

Similarly, FIG. 3 illustrates the bottom face 56 of the panel 52 when the panel 52 is not positioned inside of the container 51. FIG. 3 illustrates the several slots and orifices extending from the top face 54 of the panel to the bottom face 56. It further illustrates several compartments 84, 86 do not extend from the top face 54 to the bottom face 56 (see FIG. 2 for comparison). As illustrated and discussed below, the size of the knife handles, etc. are too large to pass through the slots 64, 66, 78, 80, 82. That is, the knives and saws pass through the slots but their handles do not. As a result, the slots are great for storing knives and saws. By contrast, the slots are not conducive for storing pencils, utility knives and several other tools. To meet this need, the illustrated embodiment comprises the pencil holder 84 and the utility knife holder 86.

This figure also illustrates the bottom face 56 having a first brush handle 88, a second brush handle 90, a first plurality of bristles 92 and a second plurality of bristles 94. In this embodiment, the first brush handle 88 is attached to the bottom face and extends across/covers part of the orifice 68. Similarly, the second brush handle 90 is attached to the bottom face and extends across part of the orifice 68, opposite the first brush handle 88. The first plurality of bristles 92 extend from the first brush handle 88 and the second plurality of bristles 94 extend from the second brush handle 90. The plurality of bristles 92, 94 extend across part of the orifice 68. It is intended that a user will insert one or more knives, blades, etc. through the orifice 68 from the side of the top face 54 past the bottom face 56. The movement of such a knife past the bristles will remove of sheetrock or other material then stuck to the knife. Thrusting the knife repeatedly and/or in and out of water held in the container will further facilitate this objective. In this embodiment and several embodiments, it is contemplated that the first plurality of bristles 92 and the second plurality of bristles 94 overlap or are at least sufficiently proximate one another to effectively brush away material stuck to a knife.

In this embodiment the first brush handle 88 and second brush handle 90 are removable from the panel 52 as illustrated by the hardware shown in the several figures showing the top face of the panel 52. Removability allows for replacement, if necessary, varying sizes or materials.

Figure 4:
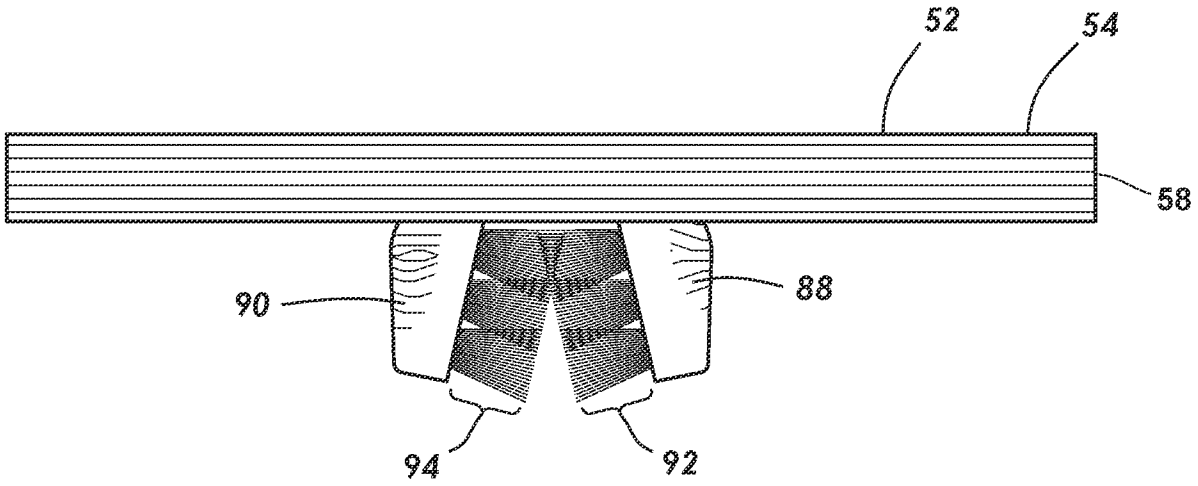
FIG. 4 is a side view of part of the embodiment shown in FIG. 1.

FIG. 4 is a side view of part of the embodiment shown in FIG. 1. Namely, FIG. 4 shows the side face 58 of the panel 52. In the illustrated embodiment, the side face 58 is perpendicular to both the top face 54 and the bottom face 56 and thus the panel 52 is generally a cylinder. Here, the side face 58 is generally smooth, as well.

Figure 5:
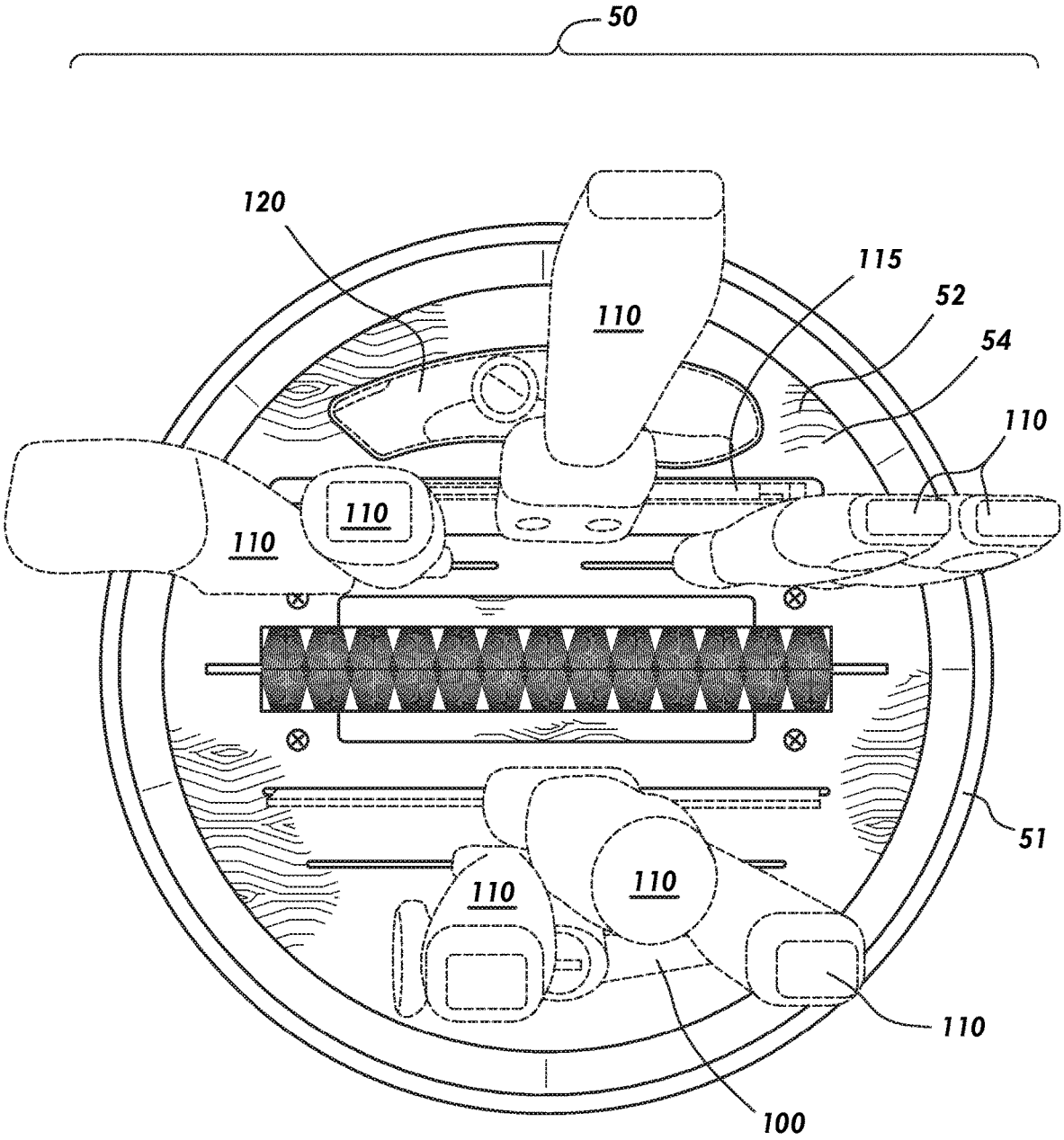
FIG. 5-FIG. 8 are top views of the embodiment shown in FIG. 1 holding several blades and other tools.

FIG. 5 illustrates a top view of the embodiment shown in FIG. 1-FIG. 4 holding several knives and other tools. The knives and tools are not part of the invention but included to show the environment in which the present invention might be used. FIG. 5 illustrates the head of hammer 110 resting above the top face 54 of the panel 52 while the hammer handle passes through hammer hole 60 and the hammer claw rests at least partially in the other hammer hole 62. FIG. 5. further illustrates the several knives/blades/saws 110 extending through the slots 64, 66, 78, 80, 82. The several slots 64, 66, 78, 80, 82 vary in size to accommodate a variety of knife sizes (compare the fourth slot 78 with the second slot 66) or different number of knives (e.g., the fourth slot 78 is shown holding a saw and a knife; the fifth slot 80 is shown holding two knives).

A pencil 115 rests inside of the pencil holder 84. The pencil holder 84 is approximately an obround shape as disclosed. Important to this embodiment, the pencil holder is sufficiently long and wide to accommodate the lengths and widths of standard pencils. The pencil holder consists of two generally parallel edges for that reason. In this embodiment, the shape is obround to account for the curvature of erasers and graphite tips at opposite ends of a pencil. In this embodiment, the pencil holder 84 is sufficiently deep that the height of the pencil does not extend beyond the surface of the top face of the panel. This can allow for an object to rest on the panel without creating an uneven surface. It also allows a container lid to close or seal the container without buckling or being inhibited.

A utility knife 120 rests inside of the utility knife holder 86. The utility knife holder 86 is approximately the shape of the utility knife 120 only slightly larger. Important to this embodiment, the utility knife holder is sufficiently long and wide to accommodate the lengths and widths of commercially available utility knives. In this embodiment, the utility knife holder 86 is sufficiently deep that the height of the utility knife does not extend beyond the surface of the top face of the panel. This can allow for an object to rest on the panel without creating an uneven surface.

Figure 6:
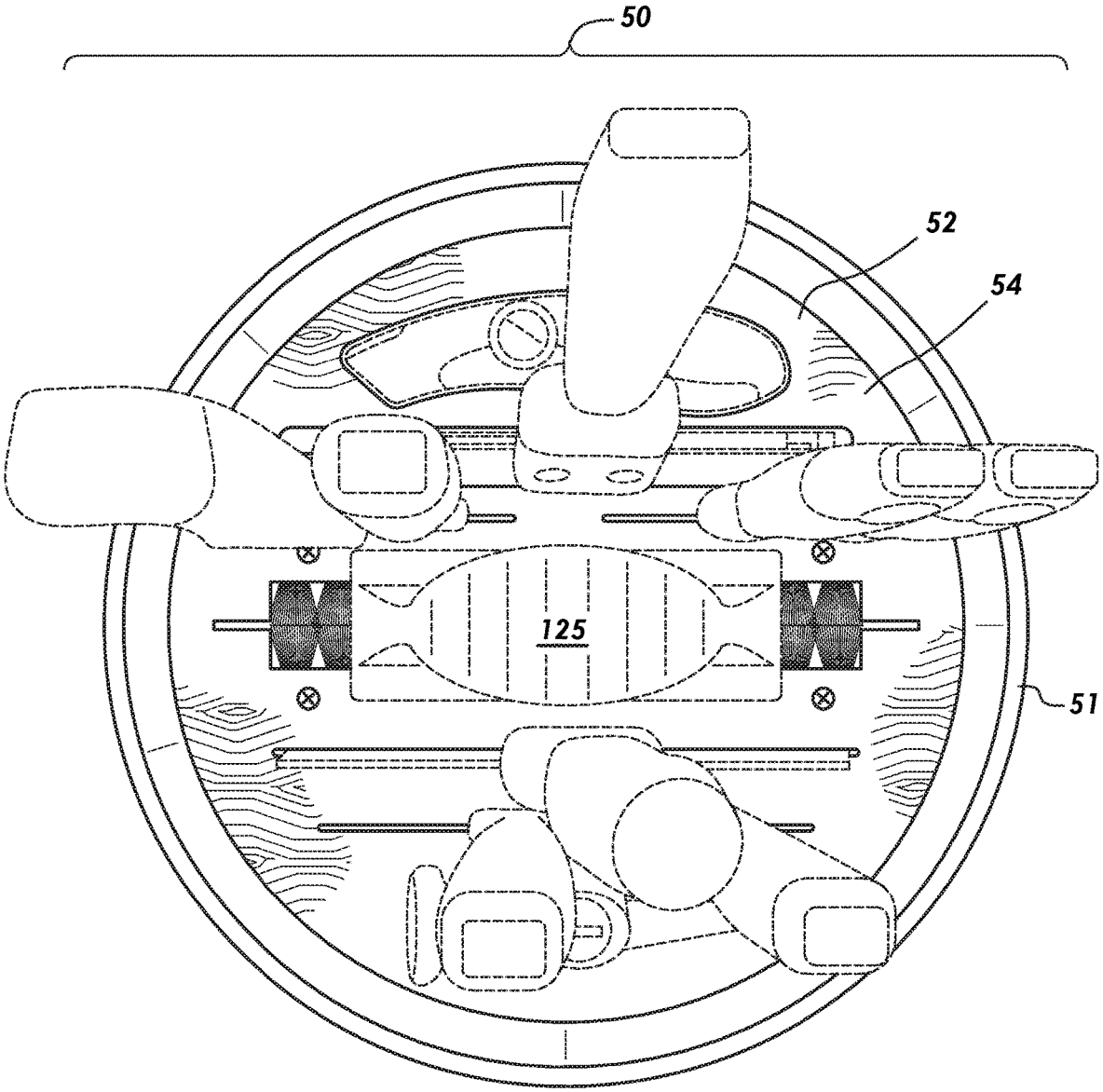

FIG. 6 illustrates several knives, blades and other tools organized in the same manner as in FIG. 5. However, FIG. 6 additionally illustrates the rasp 125 stored in the space created by the orifice 68 and the cutouts 70, 72. Further, the rasp 125 is supported gravitationally by the brush handles 88, 90 and the bristles 92, 94. In this embodiment, the wire grate and widest segment of the rasp 125 are positioned beneath the top face of the panel to keep the rasp secure.

Figure 7:
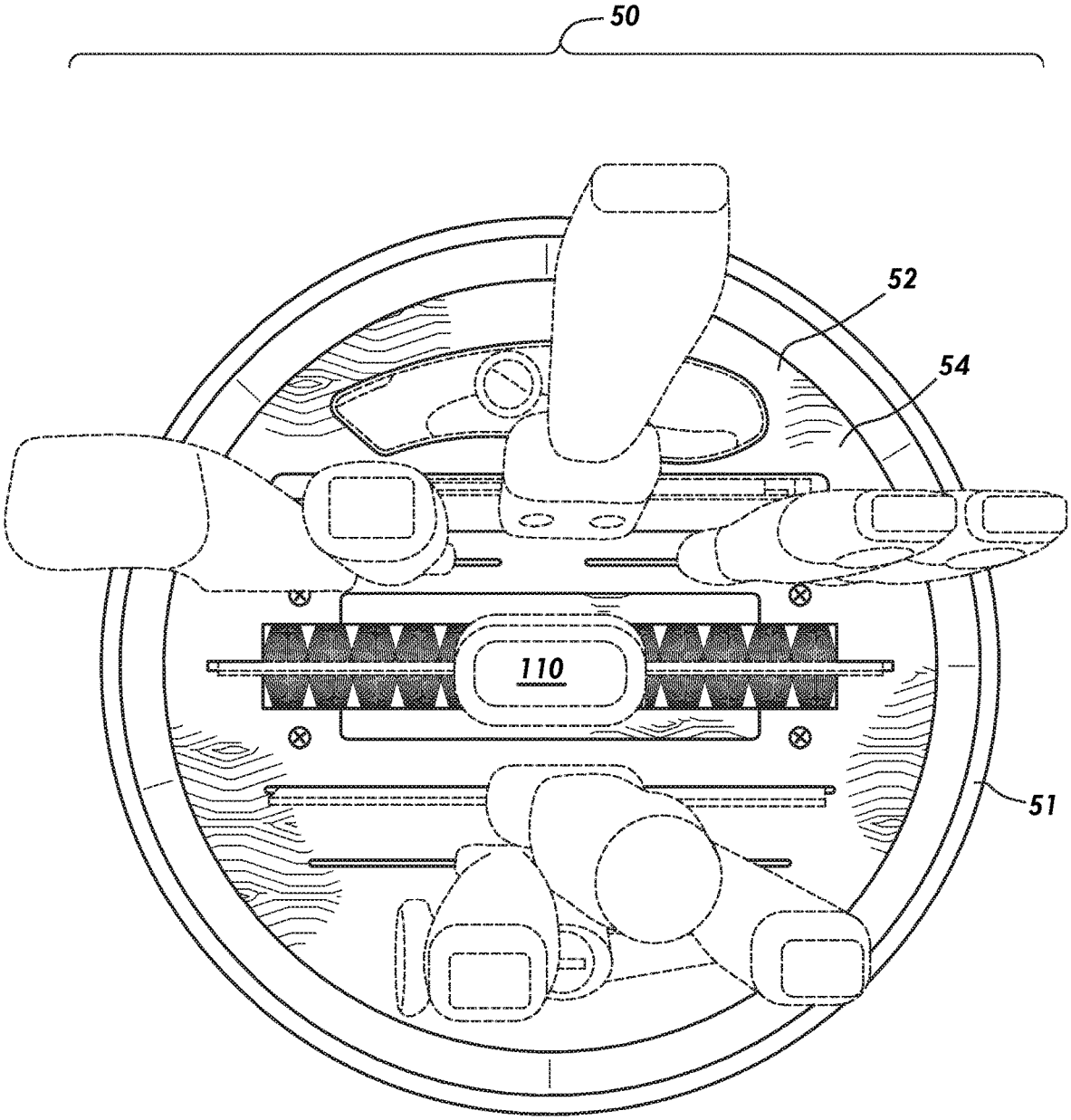

FIG. 7 illustrates an additional knife extending through the third slot 74, 76. In this particular embodiment, extending the third slot 74, 76 through the orifice 68 and cutouts 70, 72 allows accommodation of a wider knife. Moreover, the third slot is positioned approximately along the diameter of the panel 52 giving all but the longest possible dimension on the platform.

Figure 8:
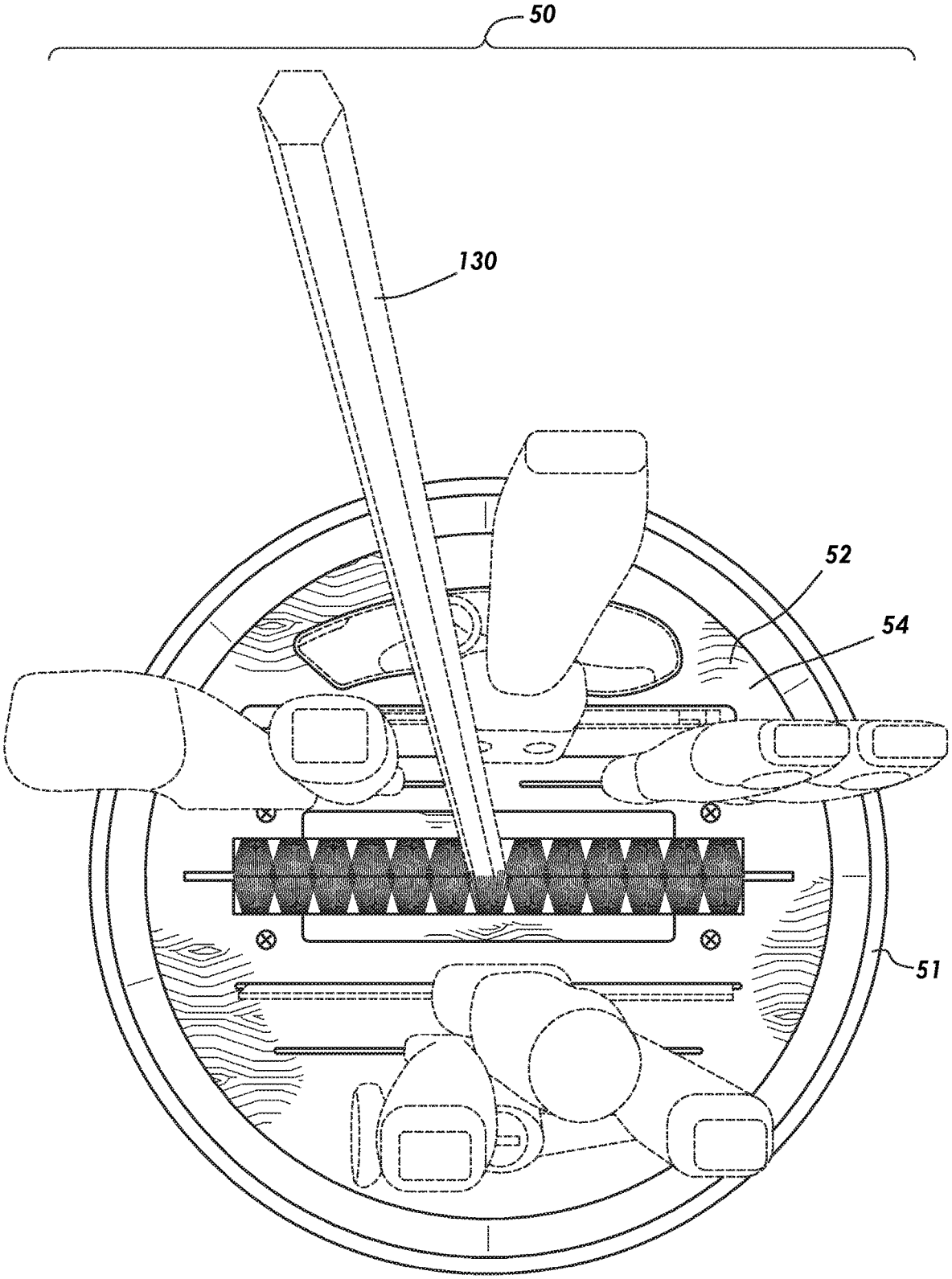

FIG. 8 illustrates several knives, blades and other tools organized in the same manner as in FIG. 5. However, FIG. 8 additionally illustrates a mud mixer 130. In particular, the mixing head (not shown in FIG. 8) is resting near the bottom of the container 51 and the mud mixer handle extends upwardly, and through the plurality of bristles 92, 94. The flexibility of bristles are such that a separate orfice is not necessary for the handle yet the bristles are sufficiently rigid and frequent that the handle is held in place. Of course, some give (i.e., movement) is expected.

Figure 9:
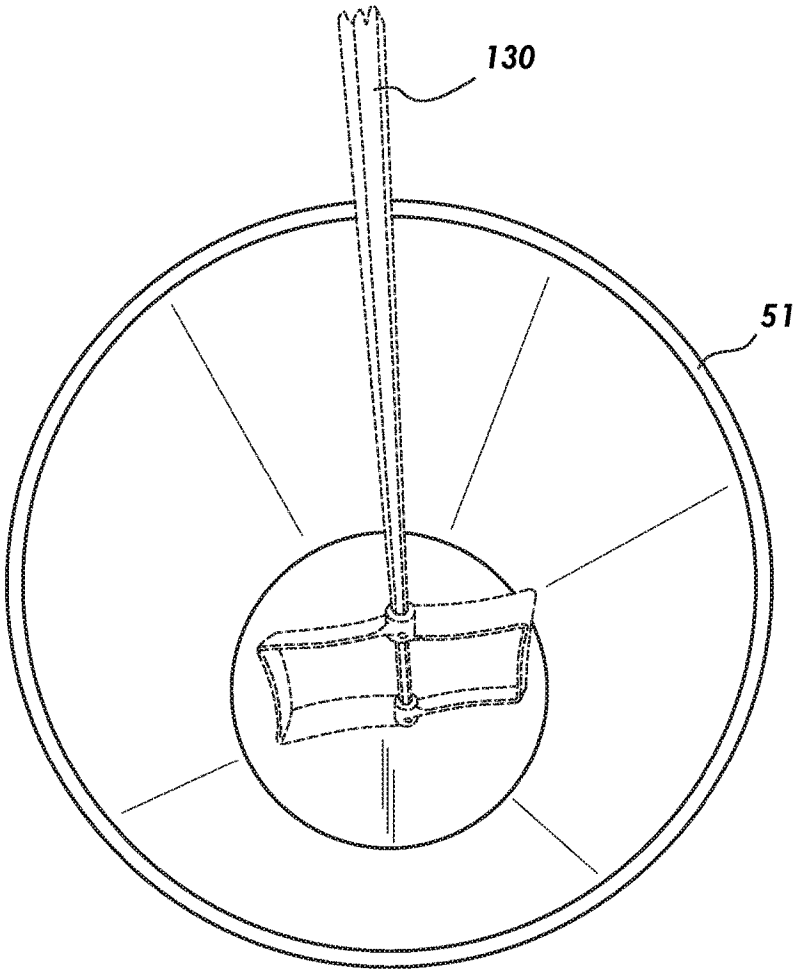
FIG. 9 is a top plan view of part of the present invention holding a mud mixing tool.

FIG. 9 shows the same embodiment of FIG. 8 without the panel and various knives, blades, pencil and utility knife. FIG. 9 shows the mud mixer 130 resting inside of the container 51 with the mud mixing handle extending out of the container 51.

Figure 10:
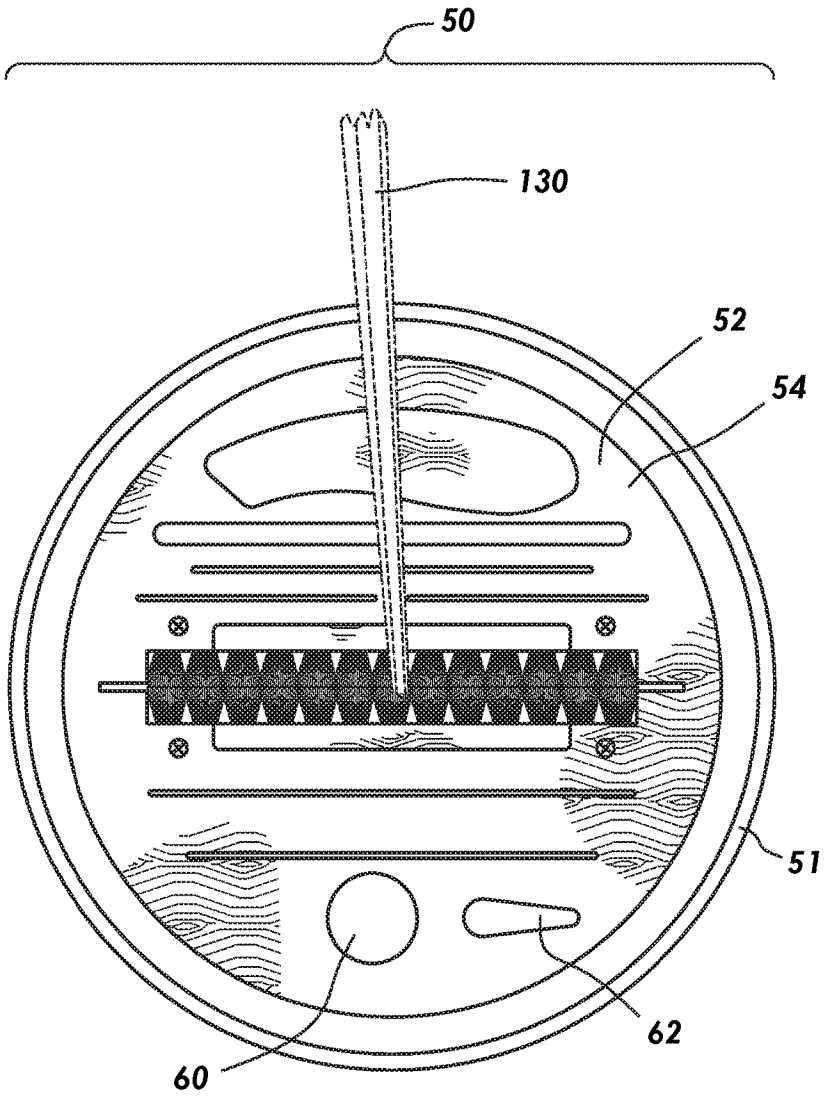
FIG. 10 is an alternate view of the embodiment shown in FIG. 9.

FIG. 10 illustrates the same embodiment of FIG. 8 sans the various knives, blades, pencil and utility knife.

Figure 11:
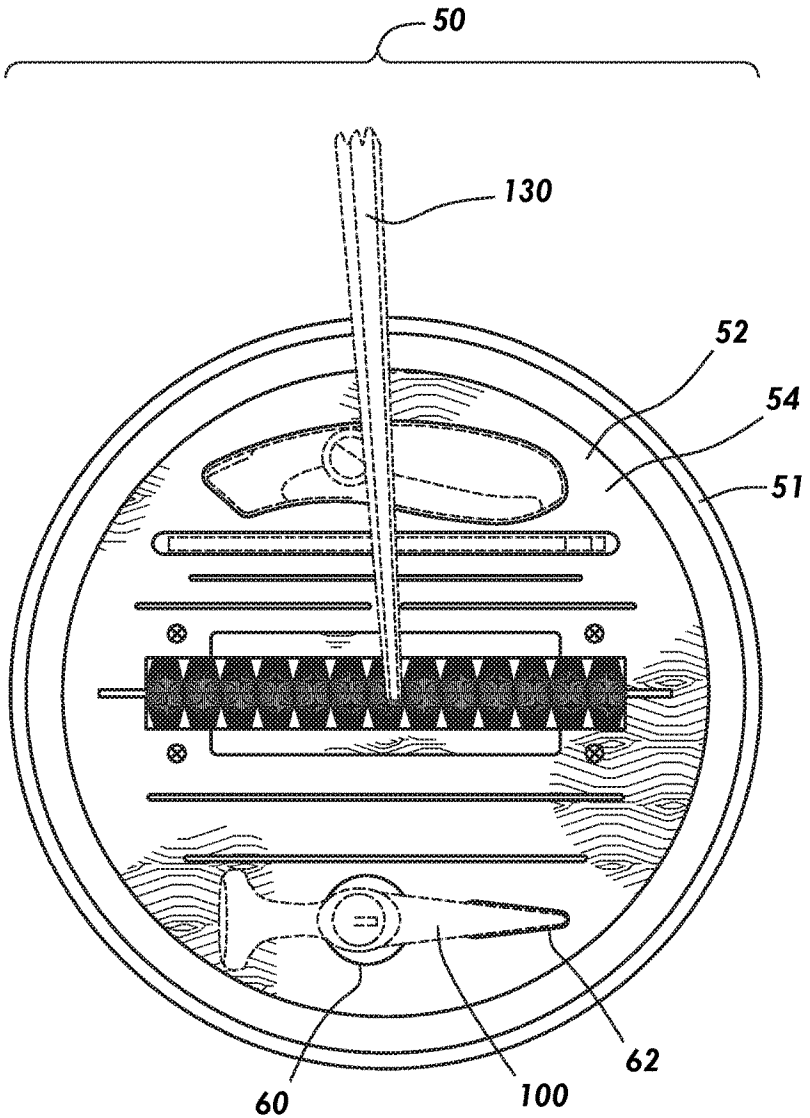
FIG. 11 is a view of the embodiment shown in FIG. 10 holding several blades and other tools.

FIG. 11 illustrates the same embodiment of FIG. 10 with the addition of a hammer 100 and a utility knife 120.

Figure 12:
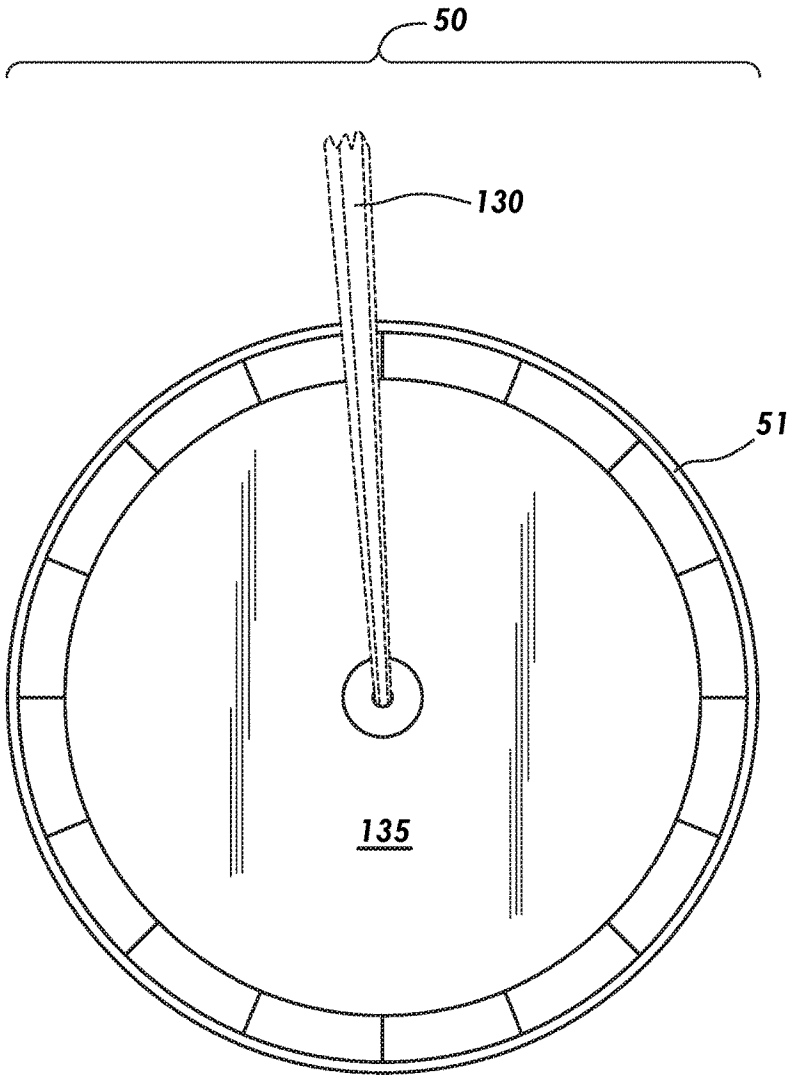
FIG. 12 is a view of the device shown in FIG. 10 and FIG. 11 covered in part by a lid.

FIG. 12 illustrates the present invention covered in part by a lid 135. The mud mixer 130 extends through a gasket in the lid 135.

The present invention is described above in terms of preferred illustrative embodiments. Those skilled in the art will recognize that alternative constructions of such an apparatus, system, and method can be used in carrying out the present invention. Other aspects, features, and advantages of the present invention may be obtained from a study of this disclosure and the drawings, along with the appended claims.

In alternative embodiments, where the panel and container are not cylinders, the two structures will be of generally the same shape where the outer diameter of the panel is approximately the same but slightly less than the inner diameter of the container such that the panel can rest in the container at a desired height. For example, the panel and container could be squares, rectangles, triangles, etc. In further alternative embodiments, the panel and container could be different shapes and the panel and container could connect via arms or other attachment means. In further alternative embodiments, the panel might rest on top of the container. Further, the panel might have a lip to add stability.

In alternative embodiments, the panel could be permanently connected to the container and not removable. In alternative embodiments, the panel could have rubber or other shoulders/materials to increase or decrease the friction between the panel and the container.

The figures show a panel having a pencil holder and a utility knife holder. In alternative embodiments the panel (or even the container) might have different compartments/holders. There might be a leveling holder or a holder for other tools used with sheetrock installation or removal or other carpentry, plumbing, etc. applications.

The figures show a panel having two brushes with bristles extending over the orifice. In several embodiments, it is contemplated that the first plurality of bristles 92 and the second plurality of bristles 94 overlap or are at least sufficiently proximate one another to effectively brush away material stuck to a knife. In alternative embodiments, different numbers of pluralities (e.g., one or three plus) could exist, as well as different types of brushes. Further, the brushes or bristles could be permanent rather than replaceable. Or the brushes and or bristles, could displace/translate vertically, horizontally and or rotationally.

In alternative embodiments, the plurality of bristles might be replaced or supplemented with other structures, such as fingers, a rubber blade, a row of bristles. Alternatively, the bristles might exist in varying thicknesses or rigidness. Alternatively, the type of bristles used in this embodiment could be rearranged by turning the bristles upside down or orienting the bristles at different angles.

As discussed above, the rubber fingers (i.e., bristles) described herein are illustrative and not intended to be limiting. For instance, an alternative embodiment of the present invention may include bristles in a variety and combination of quantities, characteristic shapes, dimensions, stiffness, arrangements, sizes, bristle types, etc. The different objects described herein as bristles may be characterized as bristle objects (e.g., rubber blade, rubber bristles, thin stiff bristles, boars hair bristles).

If the rubber fingers were implemented, they could be configured in a variety of physical dimensions, materials, securement with respect to sweep (e.g., attachment screws, snapping mechanism, friction). The same is true for bristles and other similarly purposed structures.

In alternative embodiments, the diameter of the top face might be different than the diameter of the bottom face (and in some instances, resulting in a taper) such that the panel is better fitted to the varying inner diameter of the bucket.

In alternative embodiments, the pencil and/or utility knife holders might be deeper or not as deep. It is contemplated in other embodiments that the pencil holder will at least be concave to hold the pencil at least partially in place. Alternatively, there might not be a concave holder but instead one or two (or more) protrusions holding the pencil in place. Or the orifice might be deeper than the height of the rasp.

In alternative embodiments, the holders might be rectangular, obround or other shapes.

In alternative embodiments, it need not be that deep. It is contemplated in other embodiments that the pencil holder will at least be concave to hold the pencil at least partially in place.

Also alternative, there might not be a concave holder but instead one or two (or more) protrusions holding the pencil in place.

In alternative embodiments, there might be an orifice or gasket in the panel to hold the mud mixer in place.

In this embodiment, the panel is approximately 1.8 centimeters (cm) thick/deep and approximately 28.35 cm in diameter. In this embodiment, hammer hole 60 has a diameter of approximately 3.85 cm and hammer hole 62 has a length of approximately 4.9 cm. The first slot 64 has a length of approximately 17.65 cm and a width of approximately of approximately 35 millimeters (mm); the second slot 66 has a length of approximately 20.9 cm and a width of approximately 35 mm; the third orifice 68 has a length of approximately 15.7 cm and a width of approximately 5.35 cm. Along part of the third orifice 68, there is a depth of 60 mm to accommodate a rasp or similar object, but the most interior segment is the same depth as the depth of the platform. The cutouts 70, 72 each have a length of 2.6 cm and a width of approximately 3 cm. Thus, the combined length of the third orifice 68 and the cutouts 70, 72 is 20.9 cm. The third slot 74, 76 has a length of approximately 25.65 cm and a width of approximately 35 mm; the fourth slot 78 has a length of approximately 10.45 cm and a width of approximately 35 mm; the fifth slot 80 has a length of approximately 8.15 cm and a width of approximately 35 mm; the sixth slot 82 has a length of approximately 17.05 cm and a width of approximately 35 mm; the pencil holder 84 has a length of approximately 19.95 cm, a width of approximately 95 mm, and a depth of approximately 55 mm; and the utility knife holder 86 extends approximately 90 mm into the panel and has remaining dimensions that are slightly larger than a Wal-Board Comfort Fixed Blade Utility Knife. These dimensions are illustrative for this embodiment but should not be construed as limiting. In several embodiments, the various dimensions may be shorter or longer and it will likely be common to find variances of ten percent (10%) shorter or longer, if not more, in alternative embodiments. The several slots will in most embodiments be wider than the width of a knife or blade to pass through but narrower in width than the handle of a handle connected to the knife or blade so that the handle does not pass through the slot.

Other elements may be arranged or designed differently, such as the various standoffs, hardware (e.g., washers) or might not be included at all. These elements should be considered illustrative rather than limiting.

Unless otherwise indicated, all numbers expressing quantities of ingredients, properties such as molecular weight, reaction conditions, and so forth used in the present specification and associated claims are to be understood as being modified in all instances by the term "about". Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claim, each numerical parameter should at least be construed in light of the number of reported significant digits and by applying ordinary rounding techniques.

Finally, all articles, books, information, journals, magazines, materials, newsletters, newspapers, online materials, patent applications, patent publications, periodicals, publications, texts, and treatises, and/or any other type of publication, cited in this application are herein incorporated by reference in their entirety as if each individual reference was specifically and individually set forth herein. It should be understood that incorporated information is as much a part of the application as filed as if the information was repeated in the application, and should be treated as part of the text of the application as filed.

We claim:

1. A blade cleaning apparatus comprising:

a panel having a top side and a bottom side;

a cleaning orifice extending from the top side to the bottom side;

a plurality of bristles connected to the bottom side of the panel, said plurality of bristles at least partially obstructing the cleaning orifice;

two or more slots extending from the top side to the bottom side; and one or more hammer holes extending from the top side to the bottom side.

2. The blade cleaning apparatus of claim 1 further comprising one or more holders extending from the top side partially into the panel.

3. The blade cleaning apparatus of claim 2 wherein the two or more slots are positioned outside of the one or more holders.

4. The blade cleaning apparatus of claim 1 further comprising:

a first strip and a second strip;

the first strip obstructing part of the cleaning orifice; and the second strip obstructing part of the cleaning orifice.

5. The blade cleaning apparatus of claim 4 wherein the first strip is a brush handle and the second strip is a brush handle.

6. The blade cleaning apparatus of claim 1 wherein the diameter of the panel along the top side is longer than the diameter of the panel along the bottom side.

7. A blade cleaning apparatus comprising:

a panel having a top side and a bottom side;

a cleaning orifice extending from the top side to the bottom side;

a plurality of bristles connected to the bottom side of the panel, said plurality of bristles at least partially obstructing the cleaning orifice;

one or more slots extending from the top side to the bottom side;

one or more hammer holes extending from the top side to the bottom side;

one or more holders extending from the top side partially into the panel wherein no portion of said one or more holders extends to the bottom side.

8. The blade cleaning apparatus of claim 7 further comprising:

a first strip and a second strip;

the first strip obstructing part of the cleaning orifice; and the second strip obstructing part of the cleaning orifice.

9. The blade cleaning apparatus of claim 8 wherein the first strip is a brush handle and the second strip is a brush handle.

10. The blade cleaning apparatus of claim 7 wherein the diameter of the panel along the top side is longer than the diameter of the panel along the bottom side.

11. A blade cleaning apparatus comprising:

a panel having a top side and a bottom side;

a cleaning orifice extending from the top side to the bottom side;

a plurality of bristles connected to the bottom side of the panel, said plurality of bristles at least partially obstructing the cleaning orifice; and three or more slots extending from the top side to the bottom side.

12. The blade cleaning apparatus of claim 11 further comprising one or more hammer holes extending from the top side to the bottom side.

13. The blade cleaning apparatus of claim 12 further comprising one or more holders extending from the top side partially into the panel.

14. The blade cleaning apparatus of claim 11 further comprising:

a first strip and a second strip;

the first strip obstructing part of the cleaning orifice; and the second strip obstructing part of the cleaning orifice.

15. The blade cleaning apparatus of claim 14 wherein the first strip is a brush handle and the second strip is a brush handle.

16. The blade cleaning apparatus of claim 11 wherein the diameter of the panel along the top side is longer than the diameter of the panel along the bottom side.

* * * * *